US009424698B2

(12) United States Patent
Yasui et al.

(10) Patent No.: US 9,424,698 B2
(45) Date of Patent: Aug. 23, 2016

(54) KEYLESS ENTRY SYSTEM

(71) Applicant: ALPS ELECTRIC CO., LTD., Tokyo (JP)

(72) Inventors: Junya Yasui, Miyagi-ken (JP); Akira Miyazawa, Miyagi-ken (JP)

(73) Assignee: ALPS ELECTRIC CO., LTD, Tokyo (JP)

( * ) Notice: Subject to any disclaimer, the term of this patent is extended or adjusted under 35 U.S.C. 154(b) by 2 days.

(21) Appl. No.: 14/559,678

(22) Filed: Dec. 3, 2014

(65) Prior Publication Data

US 2015/0170444 A1 Jun. 18, 2015

(30) Foreign Application Priority Data

Dec. 12, 2013 (JP) ..... 2013-257178

(51) Int. Cl.
*G07C 9/00* (2006.01)
*G08C 17/02* (2006.01)

(52) U.S. Cl.
CPC ..... *G07C 9/00007* (2013.01); *G07C 9/00309* (2013.01); *G08C 17/02* (2013.01); *G07C 2009/0038* (2013.01); *G07C 2009/00341* (2013.01); *G07C 2009/00547* (2013.01)

(58) Field of Classification Search
CPC ..... G07C 9/00111; G07C 2009/00317; G07C 2009/00325; G07C 2009/00333; G07C 2009/00341; G07C 2009/00349; G07C 2009/357; G07C 2009/00365; G07C 2009/0038; G07C 9/00007; G07C 9/00; G08C 17/02; G06F 17/00
USPC ..... 340/5.61–5.65; 701/2
See application file for complete search history.

(56) References Cited

U.S. PATENT DOCUMENTS 6,480,103 B1 * 11/2002 McCarthy ..... B60Q 3/06 340/425.5
2008/0054649 A1 * 3/2008 Ueda ..... E05B 81/78 292/216
2010/0003940 A1 * 1/2010 Sanji ..... H04W 52/0225 455/254
2013/0090783 A1 4/2013 Katou

FOREIGN PATENT DOCUMENTS

JP 2013-083051 5/2013

* cited by examiner

*Primary Examiner* — Allen T Cao
(74) *Attorney, Agent, or Firm* — Beyer Law Group LLP

(57) ABSTRACT

In a keyless entry system including an in-vehicle device, and a portable device operated by a built-in battery, a request signal is transmitted from the in-vehicle device to the portable device so that wireless communication is performed between the in-vehicle device and the portable device, the portable device can set first sensitivity that is predetermined sensitivity and second sensitivity that is higher sensitivity than the first sensitivity and at which a detection area for the request signal is wide, as detection sensitivity for detecting the request signal, sets the detection sensitivity to the second sensitivity when determining that the portable device is in the vehicle's interior or within the predetermined distance from the vehicle, and sets the detection sensitivity to the first sensitivity when determining that the portable device is not in or comes to be not in the vehicle's interior or within the predetermined distance from the vehicle.

12 Claims, 6 Drawing Sheets

KEYLESS ENTRY SYSTEM

CLAIM OF PRIORITY

This application claims benefit of Japanese Patent Application No. 2013-257178 filed on Dec. 12, 2013, which is hereby incorporated by reference.

BACKGROUND OF THE INVENTION

1. Field of the Invention

The present invention relates to a keyless entry system that locks or unlocks a door of a vehicle by performing wireless communication between an in-vehicle device and a portable device, and more particularly, to a passive keyless entry system having a function of automatically communicating between an in-vehicle device and a portable device.

2. Description of the Related Art

In a moving vehicle such as a car, a door lock is provided in a door of the car so as to prevent the car from being robbed or to prevent the car from being invaded and devices inside the car being damaged when the car is not used. In the related art, locking or unlocking of the door lock is performed by inserting a key for engine start-up into a key hole. However, a so-called keyless entry system that performs unlocking or locking of the door lock by operating a switch of a portable device instead of inserting a key into a key hole is used from the viewpoint of convenience. Further, in recent years, a so-called passive keyless entry system that automatically performs locking or unlocking of a door lock if a predetermined portable device is carried and located in a predetermined region instead of a switch of the portable device being operated is used. Further, the passive keyless entry system is caused to have an electrical authentication function regarding start-up of an engine, and the engine is prevented from starting when authentication is not successful between a car body and the portable device for high security.

In an operation of the keyless entry system, when a person carrying a portable device registered in an in-vehicle device mounted in a car in advance approaches the car, a request signal that is a low frequency signal containing a start-up signal is transmitted from the in-vehicle device. Also, when the portable device receives the request signal, the portable device responsively transmits an answer signal that is a high frequency signal containing an instruction signal, and the in-vehicle device controls a controlled device according to the instruction signal contained in the answer signal when the in-vehicle device receives the answer signal. This control, for example, unlocks the door of the car or starts up the engine of the car, and thus, a car driver comes to be able to drive the car.

The keyless entry system in which such a series of operations are performed includes a keyless entry system having a function of contributing to start-up of an engine when a portable device is in a car's interior, and a keyless entry system having a function of contributing to locking or unlocking of a door lock when a portable device is in a car's exterior. Further, there is a keyless entry system having a function of preventing a door from being locked when the portable device is in the car's interior so as to prevent the portable device from being misplaced in the car's interior.

In such a keyless entry system, it is important to detect whether the portable device is in the car's interior or the car's exterior with high precision. A keyless entry system in which a plurality of antennas transmitting a request signal are arranged in the car's interior or in both the car's interior and the car's exterior is known as the keyless entry system that performs the detection or the determination. Also, according to this type of keyless entry system, since the request signal is transmitted from the in-vehicle device through the plurality of antennas, transmission and reception of a radio signal can be reliably performed between the in-vehicle device and the portable device if the portable device is in the car's interior or within a predetermined range outside the car. Accordingly, it can be accurately determined whether the portable device is in the car's interior or the car's exterior.

In the related art, in the portable device in these keyless entry systems, detection sensitivity of the signal is always set to high sensitivity in order for the request signal transmitted from the in-vehicle device to be necessarily detected. Therefore, there is a problem in that consumption of a battery for a power supply built in the portable device increases. In order to solve this problem, an invention of a keyless entry system in which reduction of battery lifespan is suppressed by switching the detection sensitivity is disclosed in Japanese Unexamined Patent Application Publication No. 2013-083051. A schematic configuration of a vehicle control system 900 described in Japanese Unexamined Patent Application Publication No. 2013-083051 is illustrated in FIG. 6.

The vehicle control system 900 includes a smart key 910 operated by a built-in battery and carried by a user, and a collation ECU 950 mounted on a vehicle 980, and is configured so that wireless communication is performed between the smart key 910 and the collation ECU 950. Also, the smart key 910 periodically switches between predetermined normal sensitivity and high sensitivity at which a detection area of a transmission signal is wider than that at the normal sensitivity as detection sensitivity for detecting a transmission signal transmitted from the collation ECU 950. Accordingly, since it is not always necessary to detect the transmission signal with high sensitivity, current consumption of the battery can be reduced. As a result, reduction of lifespan of the battery built in the smart key 910 can be suppressed.

However, there are the following problems with the vehicle control system 900 described in Japanese Unexamined Patent Application Publication No. 2013-083051. A case in which it is necessary for the smart key 910 that is a portable device to detect the transmission signal transmitted from the collation ECU 950 that is an in-vehicle device includes only a case in which the smart key 910 is in the vehicle's interior or near the vehicle. Therefore, in other cases, it is not necessary to detect the transmission signal from the collation ECU 950. However, in the vehicle control system 900, periodic switching occurs between the normal sensitivity and the high sensitivity regardless of a position of the smart key 910. Therefore, a period of the high sensitivity in which current consumption of the battery increases is unnecessarily long. As a result, reduction of lifespan of the battery built in the smart key 910 cannot be sufficiently suppressed.

SUMMARY OF THE INVENTION

The present invention has been made in view of such a technical background, and provides a keyless entry system capable of switching detection sensitivity according to a position of a portable device and suppressing reduction of lifespan of a battery built in a portable device.

According to an aspect of the invention, there is provided a keyless entry system including: an in-vehicle device mounted on a vehicle, and a portable device carried by a user and operated by a built-in battery, a request signal being transmitted from the in-vehicle device to the portable device and an answer signal to the request signal being transmitted from the portable device so that wireless communication is performed between the in-vehicle device and the portable device, in which the portable device includes a control unit that is capable of setting first sensitivity that is predetermined sensitivity and second sensitivity that is higher sensitivity than the first sensitivity and at which a detection area for the request signal is wide, as detection sensitivity for detecting the request signal, determines whether the portable device is in a vehicle's interior or within a predetermined distance from the vehicle from intensity of the request signal, and switches between the first sensitivity and the second sensitivity, the control unit sets the detection sensitivity to the second sensitivity when determining that the portable device is in the vehicle's interior or within the predetermined distance from the vehicle, and the control unit sets the detection sensitivity to the first sensitivity when determining that the portable device is not in or comes to be not in the vehicle's interior or within the predetermined distance from the vehicle.

In the keyless entry system configured in this way, when the portable device is in the vehicle's interior or within a predetermined distance from the vehicle and it is necessary to increase the detection sensitivity for the request signal, the detection sensitivity is set to second sensitivity that is high sensitivity, and thus, the detection area is widened and the position of the portable device can be accurately determined. Further, when it is determined that the portable device is not in or comes to be not in the vehicle's interior or within a predetermined distance from the vehicle and it is not necessary to increase the detection sensitivity, the detection sensitivity is set to the first sensitivity lower than the second sensitivity, and thus, there is no increase in the current consumption of the battery in the portable device. As a result, it is possible to suppress reduction of lifespan of the battery in the portable device.

Further, in the above-described configuration, the in-vehicle device may transmit the request signal when an operation of opening the door of the vehicle from the vehicle's interior is performed and then an operation of locking the door of the vehicle from the outside of the vehicle is performed, and the portable device may perform authentication of the transmitted request signal, determine that the portable device is away by a predetermined distance or greater from the vehicle when the authentication is successful, and set the detection sensitivity to the first sensitivity.

In the keyless entry system configured in this way, when a user locks the door of the vehicle outside the vehicle at the time of getting-off, it is determined that the portable device is away a predetermined distance or greater from the vehicle when the authentication is successful, and the detection sensitivity is set to the first sensitivity lower than the second sensitivity. Thus, the battery is not unnecessarily consumed. Therefore, there is no increase in current consumption of the battery.

Further, in the above-described configuration, the in-vehicle device may transmit the request signal when an operation of opening the door of the vehicle from the vehicle's interior is performed, and subsequently, an operation of locking the door of the vehicle from the outside of the vehicle is performed, and the portable device may perform authentication of the transmitted request signal, and set the detection sensitivity to the first sensitivity after a predetermined time lapses when the authentication is not successful.

In the keyless entry system configured in this way, when the user locks the door of the vehicle outside the vehicle at the time of getting-off, it is determined that the portable device is away a predetermined distance or greater from the vehicle when the authentication is not successful, and the detection sensitivity is set to the first sensitivity lower than the second sensitivity after a predetermined time lapses. Further, even when the portable device is not away a predetermined distance or greater from the vehicle, the detection sensitivity is forcibly set to the first sensitivity lower than the second sensitivity after a predetermined time lapses in consideration of communication failure caused by jamming waves. Thus, the battery is not unnecessarily consumed, and there is no increase in current consumption of the battery.

Further, in the above-described configuration, the in-vehicle device may transmit the request signal when it is detected that an operation of opening the door of the vehicle from the vehicle's interior is performed and the portable device is outside the vehicle without an operation of locking the door of the vehicle being subsequently performed, and when the portable device is away a predetermined distance or greater from the vehicle, the portable device may transmit the answer signal to the in-vehicle device to cause the door of the vehicle to be locked, and set the detection sensitivity to the first sensitivity.

In the keyless entry system configured in this way, if the user does not lock the door of the vehicle outside the vehicle at the time of getting-off, when the portable device is away a predetermined distance or greater from the vehicle, the detection sensitivity is set to the first sensitivity lower than the second sensitivity, and thus, the battery is not unnecessarily consumed. Therefore, there is no increase in current consumption of the battery. Further, simultaneously, the door of the vehicle is caused to be locked, and thus, it is possible to prevent someone from invading the vehicle's interior and devices on the inside from being damaged or stolen even when the user forgets to lock the door.

BRIEF DESCRIPTION OF THE DRAWINGS

FIG. 3 is a flowchart illustrating content of a process at the time of getting-on;

DETAILED DESCRIPTION OF THE INVENTION

Hereinafter, embodiments of the present invention will be described with reference to the drawings.

Figure 1:
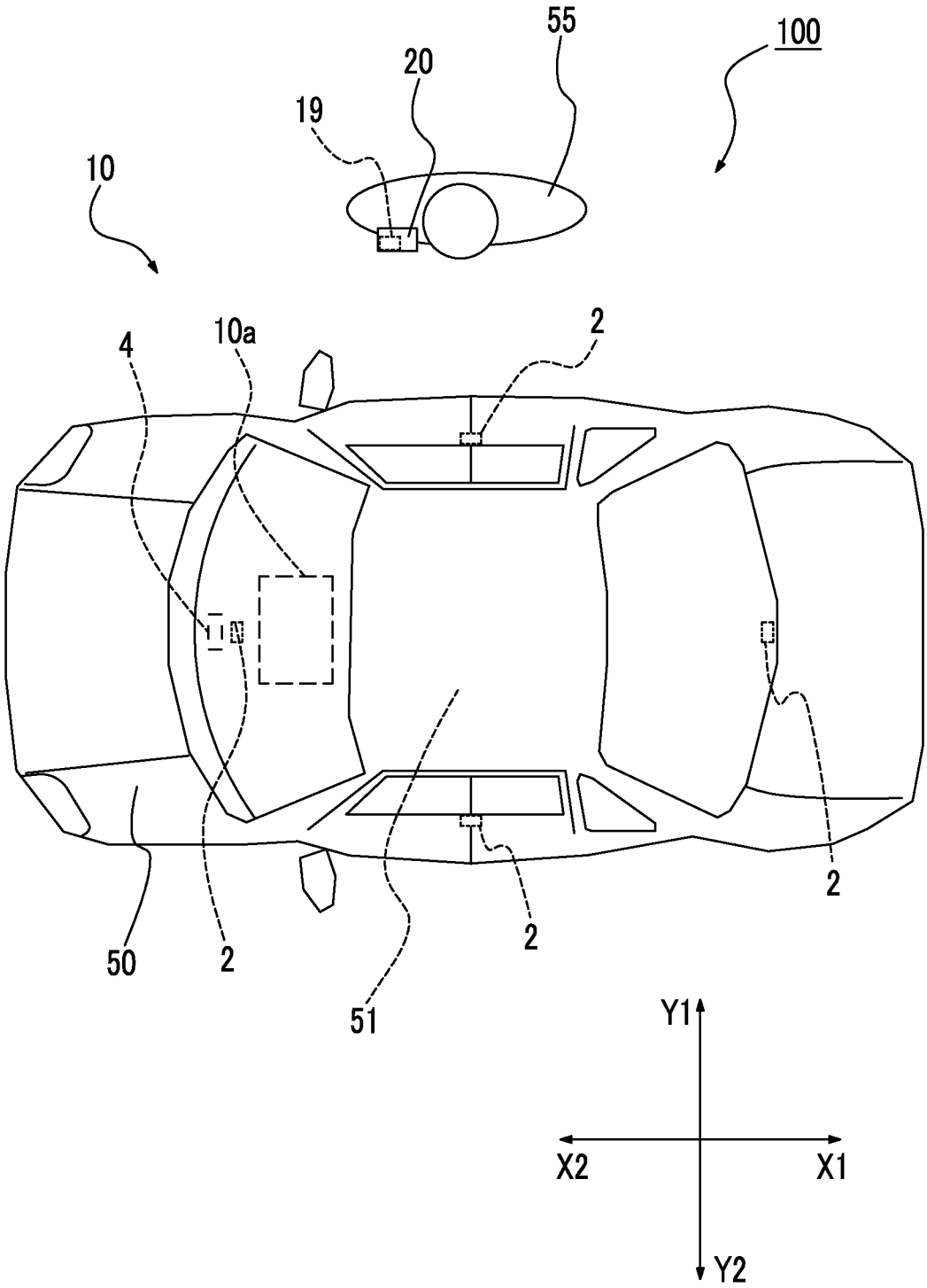
FIG. 1 is a diagram illustrating a schematic configuration of a keyless entry system.

FIG. 1 is a diagram illustrating a schematic configuration of a keyless entry system 100, and is a plan view when a vehicle 50 including an in-vehicle device 10 and a user 55 carrying a portable device 20 are viewed from the top. The in-vehicle device 10 is mounted on the vehicle 50, and includes an in-vehicle device body 10*a*, a vehicle-side transmission antenna 2, and a vehicle-side reception antenna 4. In the keyless entry system 100, the vehicle-side transmission antenna 2 includes four antennas located in predetermined positions inside the vehicle 50, and the one vehicle-side reception antenna 4 is arranged near the in-vehicle device body 10*a*. However, an arrangement of the four vehicle-side transmission antennas 2 and the vehicle-side reception antenna 4 described herein is an example, and other arrangements may be adopted.

Further, generally, the number of the vehicle-side transmission antennas 2 may be at least 3 or more. The vehicle-side transmission antennas 2 or the vehicle-side reception antenna 4 described above is connected to the in-vehicle device body 10*a* through a wiring (not illustrated). Further, the portable device 20 is carried by the user 55 and operated by a built-in battery 19. The keyless entry system 100 has a function of performing wireless communication between the in-vehicle device 10 and the portable device 20.

The keyless entry system 100 has a function of automatically performing locking or unlocking of a door (so-called passive function) by performing wireless communication between the in-vehicle device 10 and the portable device 20 as described above and performing authentication using an ID code or the like. Further, when the user (driver) 55 carrying the portable device 20 enters a vehicle's interior 51, the keyless entry system 100 permits the user to operate a main switch without inserting a key into a key cylinder. Further, such a function is well known, and thus, a description of details thereof will be omitted.

Figure 2:
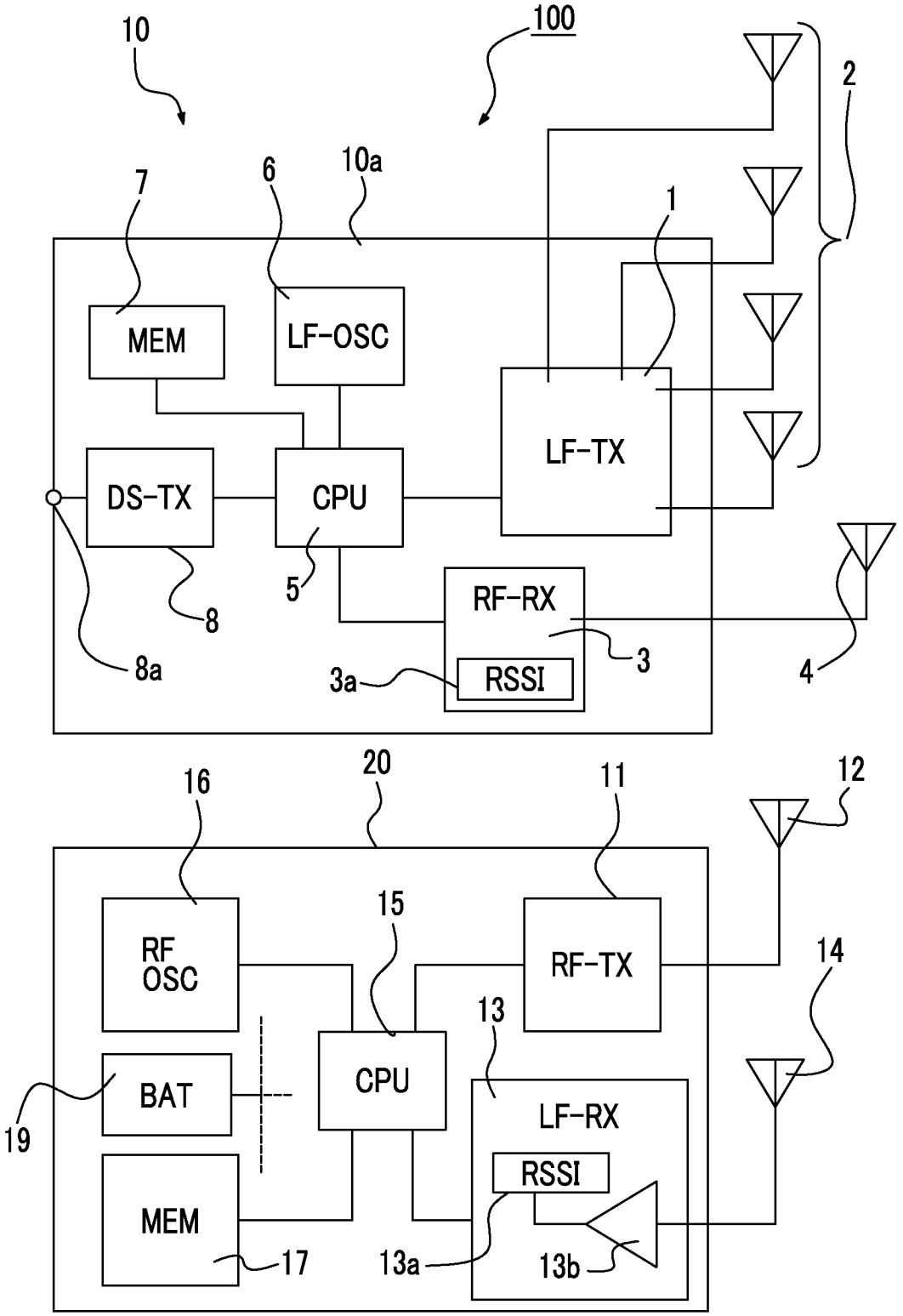
FIG. 2 is a block diagram illustrating a configuration of respective primary units of an in-vehicle device and a portable device in the keyless entry system.

FIG. 2 is a block diagram illustrating a configuration of respective primary units of the in-vehicle device 10 and the portable device 20 used for the keyless entry system 100.

The in-vehicle device 10 includes the vehicle-side transmission antennas 2, the vehicle-side reception antenna 4, and the in-vehicle device body 10*a* described above, as illustrated in FIG. 2. The in-vehicle device body 10*a* includes a vehicle-side transmission unit (LF-TX) 1, a vehicle-side reception unit (RF-RX) 3, a vehicle-side control unit (CPU) 5, a vehicle-side oscillation unit (LF-OSC) 6, a vehicle-side storage unit (MEM) 7, and a driving signal transmission unit (DS-TX) 8. In the in-vehicle device body 10*a*, the vehicle-side control unit 5 is located at a center thereof, and controls the respective units connected to the vehicle-side control unit 5.

In the inside of the vehicle-side transmission unit 1, a plurality of vehicle-side transmission circuits (not illustrated) are provided, and each of the vehicle-side transmission circuits is connected to each of the plurality of the vehicle-side transmission antennas 2, and each input terminal thereof is connected to the vehicle-side control unit 5. The vehicle-side reception unit 3 has an input terminal connected to the vehicle-side reception antenna 4, and an output terminal connected to the vehicle-side control unit 5. Further, a received signal strength indication (RSSI) circuit 3*a* is built in the vehicle-side reception unit 3. The vehicle-side oscillation unit 6 generates a low frequency signal, and an output terminal outputting this low frequency signal is connected to the vehicle-side control unit 5. The vehicle-side storage unit 7 stores a first ID assigned to the in-vehicle device 10, and a second ID assigned to the portable device 20 that is used together with this in-vehicle device 10, and a control terminal thereof is connected to the vehicle-side control unit 5. Further, the driving signal transmission unit 8 has an input terminal connected to the vehicle-side control unit 5, and an output terminal connected to an external connection terminal 8*a*.

The low frequency signal output from the vehicle-side oscillation unit 6 is supplied to the vehicle-side control unit 5. When the low frequency signal is supplied, the vehicle-side control unit 5 reads a first ID from the vehicle-side storage unit 7 and adds necessary information containing the first read ID to the low frequency signal to form a request signal. Then, if a transmission timing of the request signal is set, this request signal is supplied to the vehicle-side transmission unit 1 under control of the vehicle-side control unit 5. Each vehicle-side transmission circuit in the vehicle-side transmission unit 1 amplifies the supplied request signal up to a signal level suitable for transmission, and supplies the amplified request signal to the vehicle-side transmission antennas 2. The request signal is wirelessly transmitted from the vehicle-side transmission antennas 2. Further, wireless transmissions from the plurality of vehicle-side transmission antennas 2 are alternately performed one by one, and the wirelessly transmission is not simultaneously performed from the two or more vehicle-side transmission antennas 2.

The vehicle-side reception unit 3 receives a high frequency signal (answer signal) containing the second ID or an instruction signal of the portable device 20 wirelessly transmitted from the portable device 20 via the vehicle-side reception antenna 4, amplifies the received answer signal into a predetermined signal level using an amplification circuit (not illustrated), and supplies the amplified answer signal to the vehicle-side control unit 5. Further, the RSSI circuit 3*a* in the vehicle-side reception unit 3 can receive the amplified answer signal and detect signal strength of the answer signal. The vehicle-side control unit 5 authenticates the second ID contained in the answer signal using the second ID read from the vehicle-side storage unit 7, forms a driving signal from the instruction signal contained in the answer signal when the authentication is successful, and supplies this driving signal to the driving signal transmission unit 8. When the driving signal is supplied, the driving signal transmission unit 8 transmits the driving signal to a controlled mechanism (not illustrated), such as a motor (not illustrated) that performs locking and unlocking of a corresponding door lock or an engine start-up circuit, and the controlled mechanism is controlled according to the driving signal.

Further, for example, a low frequency signal of 125 KHz is used as the above request signal, and, for example, a high frequency signal of 315 MHz is used as the answer signal. Further, a communication distance of the request signal, that is, a detection area for the request signal is about 1 m to 2 m from the vehicle-side transmission antenna 2, and a communication distance of the answer signal, that is, a detection area for the answer signal is about 5 m to 20 m from a portable-device-side transmission antenna 12.

The portable device 20 includes a portable-device-side transmission unit (RF-TX) 11, the portable-device-side transmission antenna 12, a portable-device-side reception unit (LF-RX) 13, a portable-device-side reception antenna 14, a portable-device-side control unit (CPU) 15, a portable-device-side oscillation unit (RF-OSC) 16, a portable-device-side storage unit (MEM) 17, and a battery (BAT) 19 for a power supply, as illustrated in FIG. 2. Further, an RSSI circuit 13*a* and an amplification circuit 13*b* are built in the portable-device-side reception unit 13. In the portable device 20, the portable-device-side control unit 15 is located at a center thereof, and controls the respective units connected to the portable-device-side control unit 15.

The portable-device-side transmission unit 11 has an input terminal connected to the portable-device-side control unit 15, and an output terminal connected to the portable-device-side transmission antenna 12. The portable-device-side reception unit 13 has an input terminal connected to the portable-device-side reception antenna 14, and an output terminal connected to the portable-device-side control unit 15. The portable-device-side oscillation unit 16 has an output terminal connected to the portable-device-side control unit 15. The portable-device-side storage unit 17 has a control terminal connected to the portable-device-side control unit 15. The battery 19 is connected to each unit in the portable device 20 described above, and supplies a power supply voltage to each unit.

The portable-device-side oscillation unit 16 oscillates a high frequency signal, and the oscillated high frequency signal is supplied to the portable-device-side control unit 15. In this case, the portable-device-side control unit 15 adds a necessary information signal such as the second ID or the instruction signal through frequency modulation using this high frequency signal as a carrier, and forms the answer signal. This answer signal is supplied to the portable-device-side transmission antenna 12 via the portable-device-side transmission unit 11 and wirelessly transmitted. Since the first ID assigned to the in-vehicle device 10 or the second ID assigned to the own portable device 20, and various instruction signals are stored in the portable-device-side storage unit 17, the first ID, the second ID, or various instruction signals are appropriately read under control of the portable-device-side control unit 15.

When the high frequency signal (answer signal) containing the second ID or the instruction signal is supplied from the portable-device-side control unit 15, the portable-device-side transmission unit 11 amplifies the answer signal up to a signal level suitable for wireless transmission, and wirelessly transmits the amplified answer signal via the portable-device-side transmission antenna 12. The portable-device-side reception unit 13 receives the request signal containing the first ID wirelessly transmitted from the in-vehicle device 10 via the portable-device-side reception antenna 14, amplifies the received request signal up to a predetermined signal level using the amplification circuit 13*b*, and supplies the amplified request signal to the portable-device-side control unit 15. Further, the request signal amplified by the amplification circuit 13*b* can be input to the RSSI circuit 13*a*, and the signal strength of the request signal can be detected.

In the portable-device-side control unit 15, respective distances between the portable device 20 and the plurality of vehicle-side transmission antennas 2 can be calculated based on the signal strength of the request signal obtained by the RSSI circuit 13*a* described above. Further, the portable-device-side control unit 15 can accurately determine whether the portable device 20 is in the vehicle's interior 51 or the vehicle's exterior, or a position in the vehicle's interior 51 or the vehicle's exterior in which there is the portable device 20 through trigonometry based on the respective calculated distances. Further, the distances between the portable device 20 and the plurality of vehicle-side transmission antennas 2 calculated by the portable-device-side control unit 15, and the position of the portable device 20 can be stored in the portable-device-side storage unit 17.

As described above, the RSSI circuit 13*a* in the portable-device-side reception unit 13 can detect the signal strength of the request signal wirelessly transmitted from the in-vehicle device 10. Also, the detection sensitivity when this signal strength is detected can be set by changing an amplification degree of the amplification circuit 13*b*. Further, the amplification degree of the amplification circuit 13*b* is hereinafter referred to as an LF gain.

The detection sensitivity of the RSSI circuit 13*a* can be increased by causing the LF gain to be high. Therefore, when the signal strength is detected to calculate the respective distances between the portable device 20 and the plurality of vehicle-side transmission antennas 2, the detection sensitivity of the RSSI circuit 13*a* can be second sensitivity at which the detection area is wider than that at first sensitivity by causing the LF gain to be high. Therefore, it is possible to receive the request signal from more vehicle-side transmission antennas 2. As a result, it is possible to calculate the respective distances between the portable device 20 and the plurality of vehicle-side transmission antennas 2, and the position of the portable device 20 more accurately. However, in the related art, when the LF gain is set to be always or periodically high, current consumption of the battery 19 supplying a power to the amplification circuit 13*b* increases.

Therefore, in the keyless entry system 100 of the present invention, the portable device 20 is able to set the first sensitivity that is predetermined sensitivity, and the second sensitivity that is higher sensitivity than the first sensitivity and at which a detection area of a transmission signal is wider than that at the first sensitivity, as detection sensitivity for detecting the request signal. Further, when it is determined that the portable device 20 is in the vehicle's interior 51 or within a predetermined distance from the vehicle 50, the detection sensitivity is set to the second sensitivity that is high sensitivity, and when it is determined that the portable device 20 is not in the vehicle's interior 51 or within a predetermined distance from the vehicle 50 or comes to be not in the vehicle's interior 51 or within the predetermined distance, the detection sensitivity is set to the first sensitivity lower than the second sensitivity. In other words, the LF gain is high only when the signal strength is detected to calculate respective distances between the portable device 20 and the plurality of vehicle-side transmission antennas 2, and the LF gain is lower in normal cases.

In the portable device 20, when the request signal from the in-vehicle device 10 is transmitted, a current called a dark current periodically flows in the portable device 20 so that the request signal can be reliably received. Also, when the start-up signal in the request signal is received, the portable device 20 is started up and a current flows into, for example, the portable-device-side reception unit 13 or the portable-device-side transmission unit 11 in earnest. In this case, when the detection sensitivity is set to the second sensitivity that is high sensitivity, that is, when the LF gain is set to be high (set to High), it is necessary for the current value of the dark current to be increased. On the other hand, when the detection sensitivity is set to the first sensitivity lower than the second sensitivity, that is, when the LF gain is set to be low (set to Low), the current value of the dark current is decreased. A current value of the dark current when the LF gain is set to be low (set to Low) can be about 25% smaller than the current value of the dark current when the LF gain is set to be high (set to High).

The dark current itself is a very small current of several μA, but a period of time in which the portable device 20 is not used is much longer than a period of time in which the portable device 20 is used, and thus, a difference in size of a current value of this dark current is involved in current consumption of the battery 19.

Thus, in the keyless entry system 100, since the detection sensitivity is set to the second sensitivity that is high sensitivity when the portable device 20 is in the vehicle's interior 51 or within the predetermined distance from the vehicle 50 and it is necessary to increase the detection sensitivity for the request signal, the detection area is widened and the position of the portable device 20 can be accurately determined. Further, since it is determined that the portable device 20 is not in or comes to be not in the vehicle's interior 51 or within the predetermined distance from the vehicle 50 and it is not necessary to increase the detection sensitivity, the detection sensitivity is set to the first sensitivity lower than the second sensitivity, and thus, there is no increase in the current consumption of the battery 19 in the portable device 20. As a result, reduction of lifespan of the battery 19 in the portable device 20 can be suppressed.

Next, an operation of the in-vehicle device 10 and the portable device 20 when the user 55 gets on the vehicle and when the user 55 gets off the vehicle will be described with reference to FIG. 1 and FIGS. 3 to 5.

Figure 3:
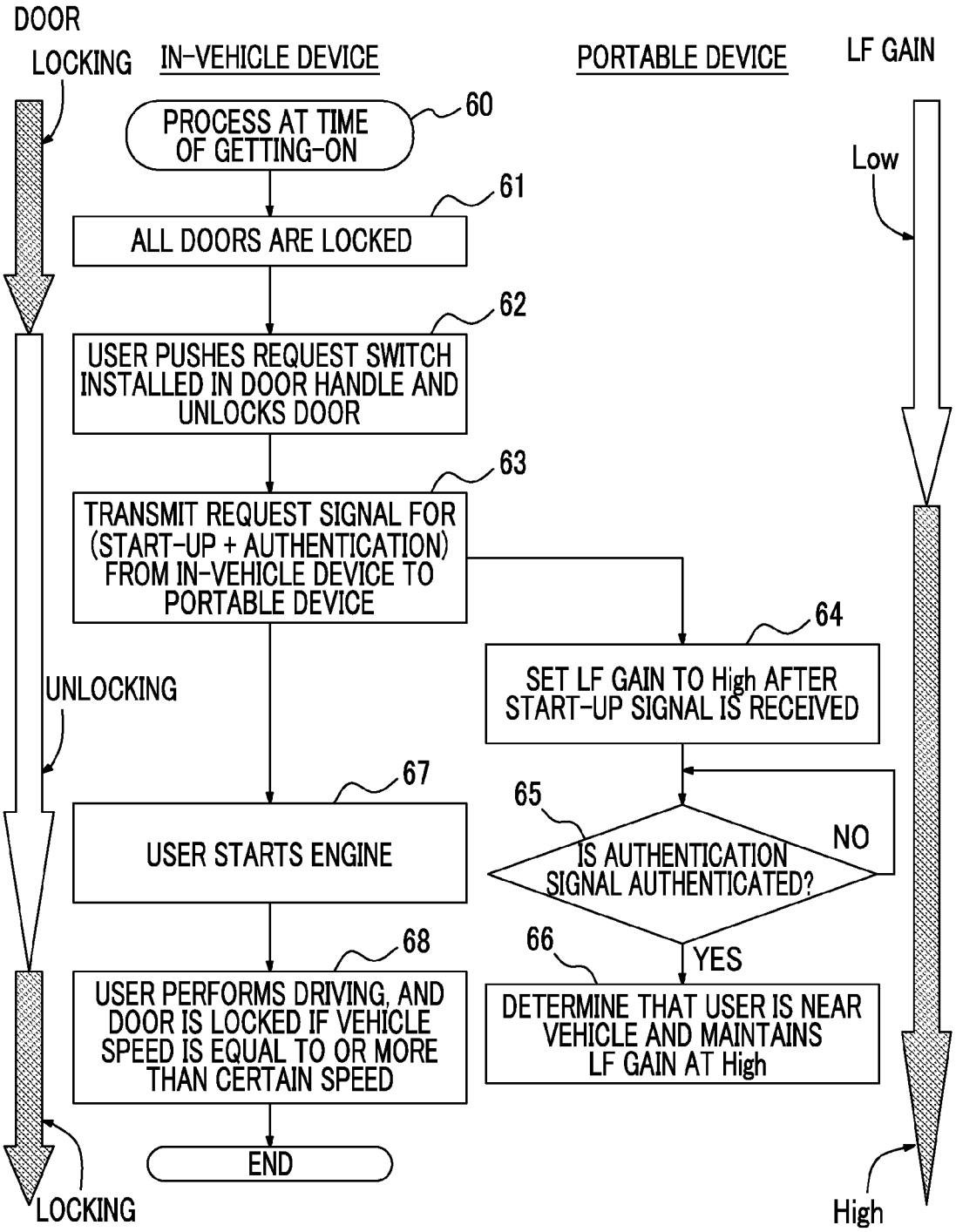
Figure 4:
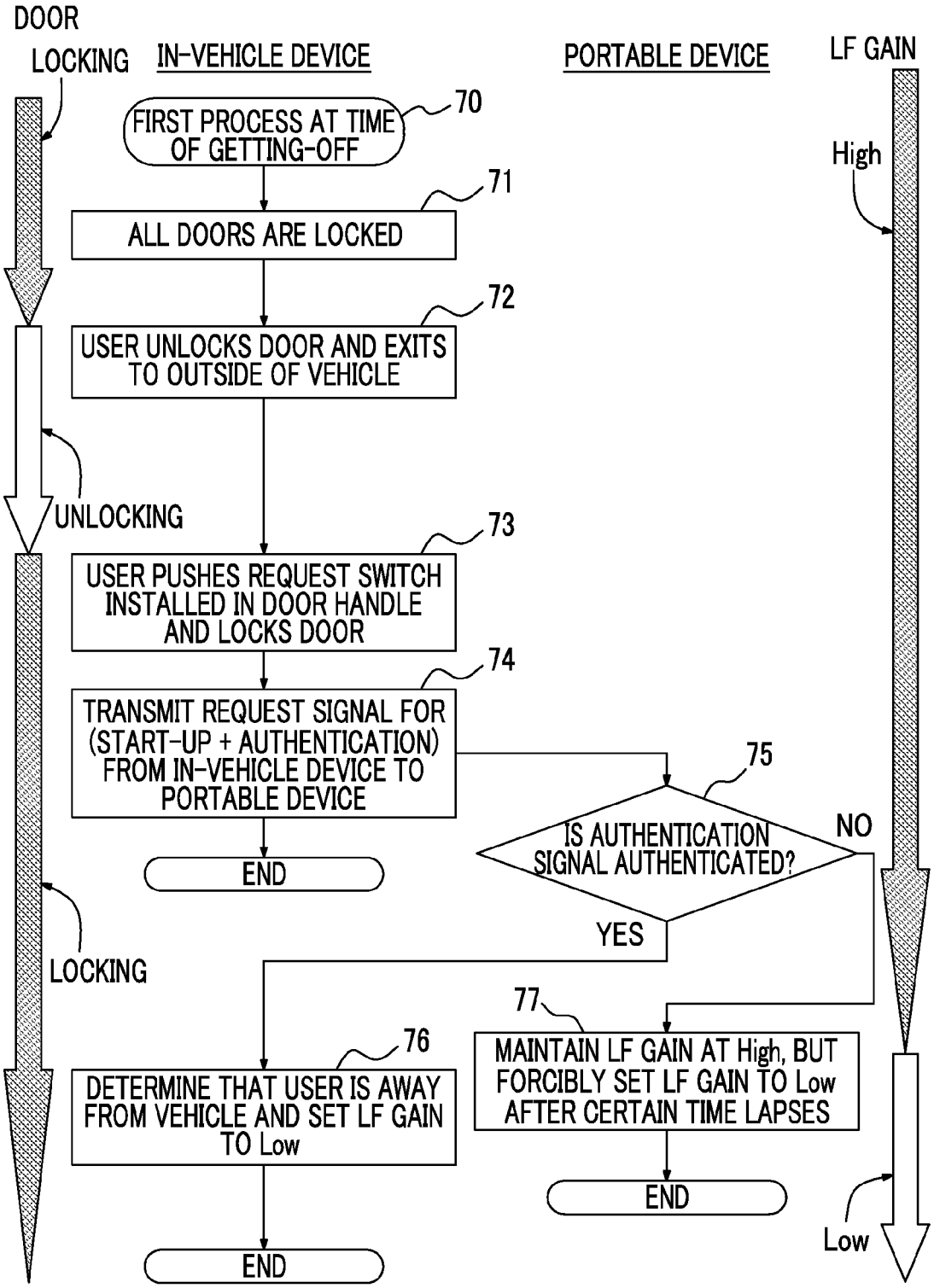
FIG. 4 is a flowchart illustrating content of a first process at the time of getting-off.
Figure 5:
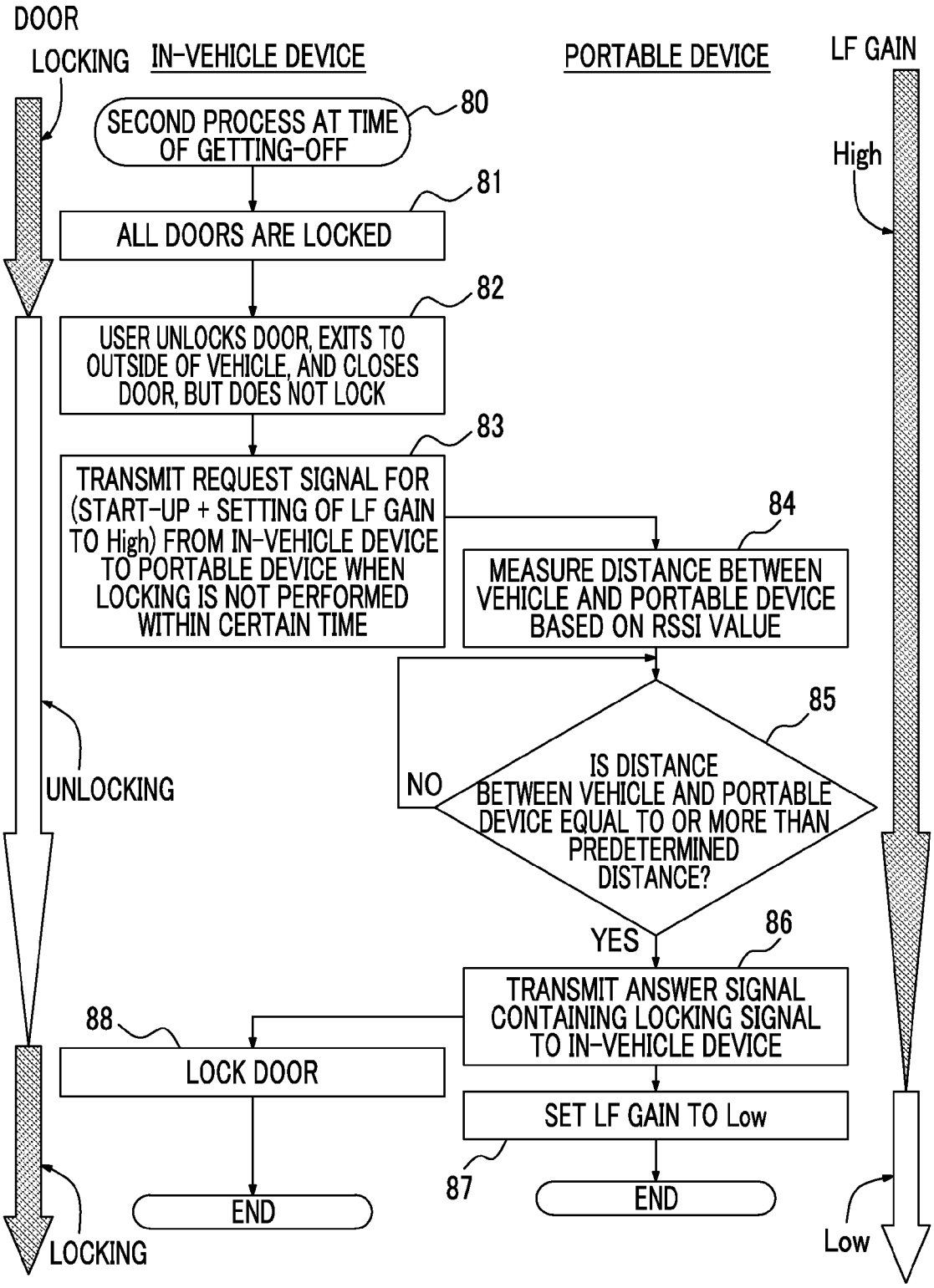
FIG. 5 is a flowchart illustrating content of a second process at the time of getting-off.
Figure 6:
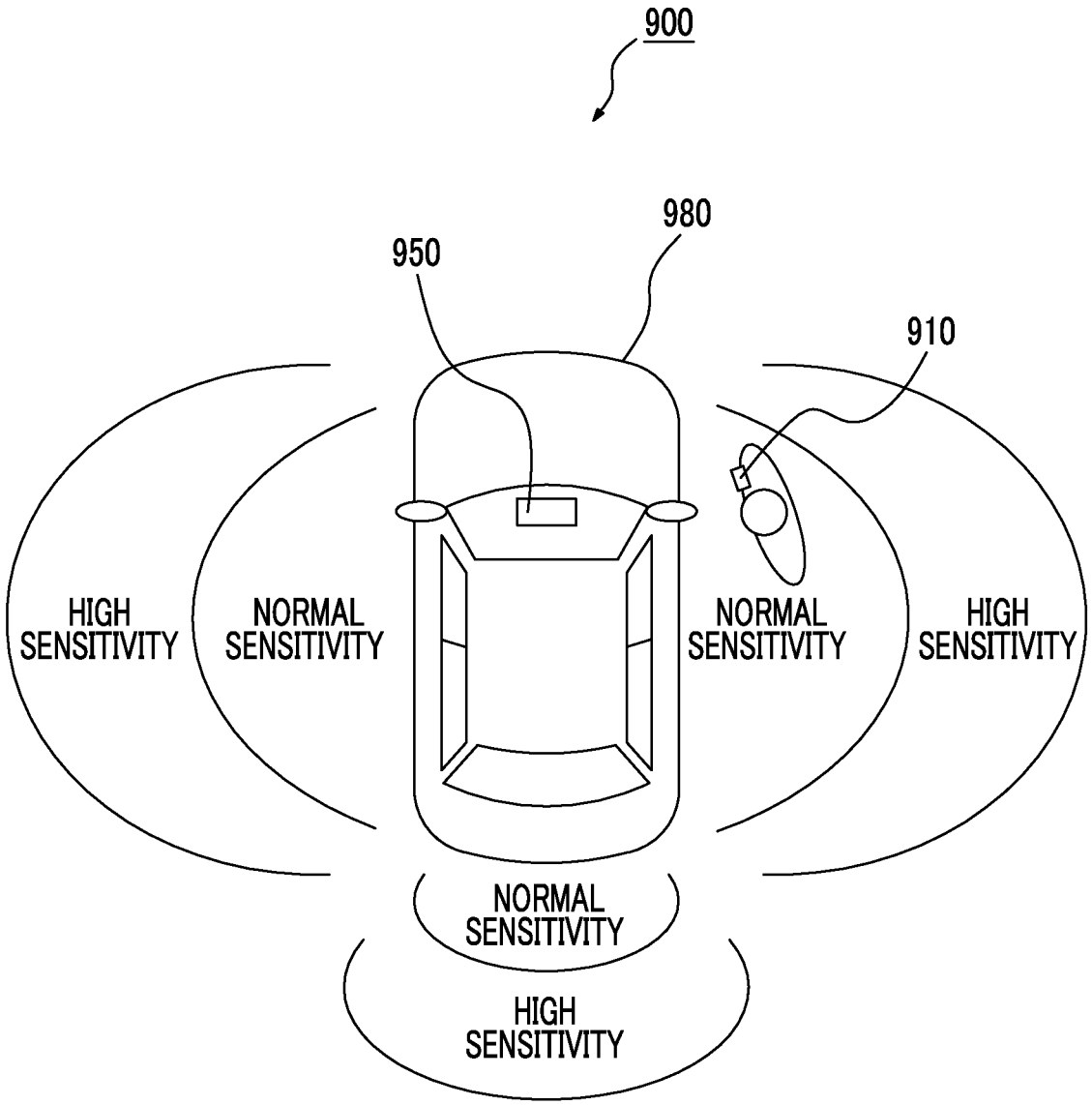
FIG. 6 is a schematic diagram illustrating a configuration of a keyless entry system according to an example in the related art.

FIG. 3 is a flowchart illustrating content of a process at the time of getting-on. Further, FIG. 4 is a flowchart illustrating processing content in a first process at the time of getting-off, and FIG. 5 is a flowchart illustrating processing content in a second process at the time of getting-off that is different from the first process at the time of getting-off.

In the in-vehicle device 10, in a process (step 60) at the time of getting-on, first, all doors of the vehicle 50 are locked, as illustrated in FIG. 3 (step 61). The user 55 pushes a request switch installed in a door handle at the time of getting-on to unlock the door (step 62). Further, "pushes the request switch" to unlock the door is expressed herein, but a mechanism for unlocking the door may have a structure "contacts with the request switch" or "holds a request switch with a hand." Then, a request signal containing a signal for (start-up+authentication) from the in-vehicle device 10 to the portable device 20 is transmitted (step 63).

In the portable device 20, the LF gain is set to Low until the request signal is received, but the LF gain is set to High after a request signal is received and the device is started up by a signal for start-up in the request signal (step 64). Then, an authentication signal in the request signal is received and authentication of the authentication signal is performed (step 65). When the authentication of the authentication signal cannot be performed, a task of authenticating the authentication signal is repeated. If the authentication signal can be authenticated, the portable device 20 determines that the user 55 is near the vehicle 50 and maintains the LF gain at High (step 66). Thereafter, the LF gain is kept at High while the user 55 is in the vehicle's interior 51.

On the other hand, in the in-vehicle device 10, the user 55 starts up the engine in the vehicle's interior 51 (step 67). Then, the user 55 drives the vehicle 50 and locks the door by oneself or when the user 55 does not lock the door, a control signal is output from the vehicle-side control unit 5 to the driving signal transmission unit 8 and the door is locked if vehicle speed of the vehicle 50 is equal to or greater than a certain speed (step 68).

Next, content of the first process at the time of getting-off will be described. Further, the first process at the time of getting-off is a process at the time of getting-off when the user 55 locks the door at the time of getting-off by oneself.

In the in-vehicle device 10, in the first process at the time of getting-off (step 70), first, all doors of the vehicle 50 are locked, as illustrated in FIG. 4 (step 71). The user 55 unlocks the door at the time of getting-off, and exits to the outside of the vehicle (step 72). Also, the user 55 pushes the request switch installed in the door handle and locks the unlocked door (step 73). At this time, the request signal containing a signal for (start-up+authentication) is transmitted from the in-vehicle device 10 to the portable device 20 (step 74).

After the request signal is transmitted, the request signal is received in the portable device 20 and authentication of the authentication signal is performed (step 75). Further, at this time, the LF gain is set to High. If the authentication signal can be authenticated, the portable device 20 determines that the user 55 carrying the portable device 20 is away from the vehicle 50, and sets the LF gain to Low (step 76). The user 55 carrying the portable device 20 is likely to stay near the vehicle 50. However, when the user 55 locks the door by oneself, the user is generally away from the vehicle 50, and thus, here, it is determined that the user 55 is away from the vehicle 50, and the LF gain is set to Low. When the user 55 enters the vehicle's interior 51 again, the process at the time of getting-on illustrated in FIG. 3 is performed.

In the authentication task (step 75), when the authentication signal cannot be authenticated, it is considered that the user 55 rapidly went away from the vehicle 50 after unlocking the door. Further, a possibility that communication between the in-vehicle device 10 and the portable device 20 fails due to jamming waves is also considered. In any case, the LF gain is maintained in a High state for a certain time. However, after a certain time lapses, particularly, when a situation is not changed, the LF gain is forcibly set to Low (step 77).

Next, content of the second process at the time of getting-off will be described. Further, the second process at the time of getting-off is a process at the time of getting-off when the user 55 does not lock the door by oneself at the time of getting-off.

In the in-vehicle device 10, in the second process at the time of getting-off (step 80), first, all the doors of the vehicle 50 are locked, as illustrated in FIG. 5 (step 81). The user 55 unlocks the door at the time of getting-off, exits to the outside of the vehicle, and closes the door. However, the user 55 does not lock the door (step 82). At this time, the portable device 20 is outside the vehicle. Then, when locking is not performed within a certain time, a request signal containing a signal for (start-up+setting of the LF gain to High) is transmitted from the in-vehicle device 10 to the portable device 20 (step 83).

On the portable device 20 side, the request signal is received and a distance between the vehicle 50 and the portable device 20 is measured based on the RSSI value obtained by the portable-device-side control unit 15, as illustrated in FIG. 5 (step 84). A result of the measurement of this distance is received, and it is determined whether the distance between the vehicle 50 and the portable device 20 is equal to or more than a predetermined distance or less than the predetermined distance (step 85). When it is determined that the distance is less than the predetermined distance, this determination is repeated. Also, when the distance between the vehicle 50 and the portable device 20 is equal to or more than the predetermined distance, an answer signal containing a locking signal is transmitted from the portable device 20 to the in-vehicle device 10 (step 86). Then, in the portable device 20, the LF gain is set to Low (step 87). Further, on the in-vehicle device 10 side, the answer signal is received, and a control signal is output from the vehicle-side control unit 5 to the driving signal transmission unit 8 to lock the door (step 88).

As described above, in the keyless entry system 100, when the user 55 locks the door of the vehicle 50 outside the vehicle at the time of getting-off, it is determined that the portable device 20 is away a predetermined distance or greater from the vehicle 50 when the authentication is successful, and sets the detection sensitivity to the first sensitivity lower than the second sensitivity. Thus, the battery 19 is not unnecessarily consumed. Therefore, there is no increase in current consumption of the battery 19.

Further, when the user 55 locks the door of the vehicle 50 outside the vehicle at the time of getting-off, it is determined that the portable device 20 is away a predetermined distance or greater from the vehicle 50 when the authentication is not successful and the detection sensitivity is set to the first sensitivity lower than the second sensitivity after a predetermined time lapses. Further, even when the portable device 20 is not away a predetermined distance or greater from the vehicle 50, the detection sensitivity is forcibly set to the first sensitivity lower than the second sensitivity after a predetermined time lapses in consideration of communication failure caused by jamming waves. Therefore, the battery 19 is not unnecessarily consumed, and there is no increase in current consumption of the battery 19.

Further, if the user 55 does not lock the door of the vehicle 50 outside the vehicle at the time of getting-off, when the portable device 20 is away a predetermined distance or greater from the vehicle 50, the detection sensitivity is set to the first sensitivity lower than the second sensitivity, and thus, the battery 19 is not unnecessarily consumed. Therefore, there is no increase in current consumption of the battery 19. Further, simultaneously, the door of the vehicle 50 is caused to be locked, and thus, it is possible to prevent someone from invading the vehicle's interior 51 and devices in the inside from being damaged or stolen even when the user 55 forgets to lock the door.

As described above, in the keyless entry system of the present invention, when the portable device is in the vehicle's interior or within the predetermined distance from the vehicle and it is necessary to increase the detection sensitivity for the request signal, the detection sensitivity is set to the second sensitivity that is high sensitivity, and thus, the detection area is widened and the position of the portable device can be accurately determined. Further, when it is determined that the portable device is not in or comes to be not in the vehicle's interior or within the predetermined distance from the vehicle and it is not necessary to increase the detection sensitivity, the detection sensitivity is set to the first sensitivity lower than the second sensitivity, and thus, there is no increase in the current consumption of the battery in the portable device. As a result, it is possible to suppress reduction of lifespan of the battery in the portable device.

The present invention is not limited to the description of the embodiments described above, and can be appropriately implemented in an aspect in which the effects are exhibited. For example, components equivalent to the components illustrated in FIG. 2 may be included in the keyless entry system of the present invention.

It should be understood by those skilled in the art that various modifications, combinations, sub-combinations and alterations may occur depending on design requirements and other factors insofar as they are within the scope of the appended claims of the equivalents thereof.

What is claimed is:

1. A keyless entry system comprising an in-vehicle device mounted on a vehicle and a portable device carried by a user, wireless communications being performed therebetween by transmitting a request signal from the in-vehicle device to the portable device and an answer signal from the portable device to the in-vehicle device in response to the request signal, wherein the portable device includes:

a built-in battery; and a control unit configured to switchably set a detection sensitivity for detecting the request signal between a first sensitivity and a second sensitivity higher than the first sensitivity based on an intensity of the request signal received, the second sensitivity providing a detection area wider than that of the first sensitivity, the control unit setting the detection sensitivity to the second sensitivity if it is determined that the portable device is inside or within a predetermined distance from the vehicle, and setting the detection sensitivity to the first sensitivity if it is determined that the portable device is not or will not be inside or within the predetermined distance from the vehicle, wherein the in-vehicle device transmits the request signal when an operation of opening a door of the vehicle is performed from inside the vehicle, followed by an operation of locking the door of the vehicle from outside the vehicle, and wherein the portable device performs authentication of the request signal received, and if the authentication is successful, determines that the portable device is away from the vehicle by the predetermined distance or greater and sets the detection sensitivity to the first sensitivity.

2. The keyless entry system according to claim 1, wherein maintaining the detection sensitivity at the second sensitivity requires more power from the built-in battery than maintaining the detection sensitivity at the first sensitivity.

3. The keyless entry system according to claim 1, wherein the control unit determines a location of the portable device and a distance from the vehicle based on the intensity of the request signal transmitted from a plurality locations on the vehicle.

4. The keyless entry system according to claim 1, wherein the control unit determines a location of the portable device and a distance from the vehicle only when the detection sensitivity is set at the second sensitivity.

5. A keyless entry system comprising an in-vehicle device mounted on a vehicle and a portable device carried by a user, wireless communications being performed therebetween by transmitting a request signal from the in-vehicle device to the portable device and an answer signal from the portable device to the in-vehicle device in response to the request signal, wherein the portable device includes:

a built-in battery; and a control unit configured to switchably set a detection sensitivity for detecting the request signal between a first sensitivity and a second sensitivity higher than the first sensitivity based on an intensity of the request signal received, the second sensitivity providing a detection area wider than that of the first sensitivity, the control unit setting the detection sensitivity to the second sensitivity if it is determined that the portable device is inside or within a predetermined distance from the vehicle, and setting the detection sensitivity to the first sensitivity if it is determined that the portable device is not or will not be inside or within the predetermined distance from the vehicle, wherein the in-vehicle device transmits the request signal when an operation of opening a door of the vehicle is performed from inside the vehicle, followed by an operation of locking the door of the vehicle from outside the vehicle, and wherein the portable device performs authentication of the request signal received, and if the authentication is not successful, sets the detection sensitivity to the first sensitivity after a predetermined time lapses.

6. The keyless entry system according to claim 5, wherein maintaining the detection sensitivity at the second sensitivity requires more power from the built-in battery than maintaining the detection sensitivity at the first sensitivity.

7. The keyless entry system according to claim 5, wherein the control unit determines a location of the portable device and a distance from the vehicle based on the intensity of the request signal transmitted from a plurality locations on the vehicle.

8. The keyless entry system according to claim 5, wherein the control unit determines a location of the portable device and a distance from the vehicle only when the detection sensitivity is set at the second sensitivity.

9. A keyless entry system comprising an in-vehicle device mounted on a vehicle and a portable device carried by a user, wireless communications being performed therebetween by transmitting a request signal from the in-vehicle device to the portable device and an answer signal from the portable device to the in-vehicle device in response to the request signal, wherein the portable device includes:

a built-in battery; and a control unit configured to switchably set a detection sensitivity for detecting the request signal between a first sensitivity and a second sensitivity higher than the first sensitivity based on an intensity of the request signal received, the second sensitivity providing a detection area wider than that of the first sensitivity, the control unit setting the detection sensitivity to the second sensitivity if it is determined that the portable device is inside or within a predetermined distance from the vehicle, and setting the detection sensitivity to the first sensitivity if it is determined that the portable device is not or will not be inside or within the predetermined distance from the vehicle, wherein the in-vehicle device transmits the request signal when an operation of opening a door of the vehicle is performed from inside the vehicle without being followed by an operation of locking the door of the vehicle from outside, the portable device being outside the vehicle, and wherein if it is determined that the portable device is away from the vehicle by the predetermined distance or greater, the portable device transmits the answer signal including an instruction to the in-vehicle device to lock the door of the vehicle, and sets the detection sensitivity to the first sensitivity.

10. The keyless entry system according to claim 9, wherein maintaining the detection sensitivity at the second sensitivity requires more power from the built-in battery than maintaining the detection sensitivity at the first sensitivity.

11. The keyless entry system according to claim 9, wherein the control unit determines a location of the portable device and a distance from the vehicle based on the intensity of the request signal transmitted from a plurality locations on the vehicle.

12. The keyless entry system according to claim 9, wherein the control unit determines a location of the portable device and a distance from the vehicle only when the detection sensitivity is set at the second sensitivity.

* * * * *